United States Patent [19]

Ohm

[11] 4,034,378

[45] July 5, 1977

[54] ANTENNA WITH ECHO CANCELLING ELEMENTS

[75] Inventor: Edward Allen Ohm, Holmdel, N.J.

[73] Assignee: Bell Telephone Laboratories, Incorporated, Murray Hill, N.J.

[22] Filed: July 21, 1975

[21] Appl. No.: 597,366

[52] U.S. Cl. ..... 343/781 CA; 343/782

[51] Int. Cl.[2] ..... H01Q 19/12

[58] Field of Search ..... 343/781, 782, 783, 840, 343/755, 756, 761, 837, 912, 18 R, 18 B, 18 D, 18 E, 18 C, 781 CA

[56] References Cited

UNITED STATES PATENTS

| | | | |
|---|---|---|---|
| 3,133,284 | 5/1964 | Privett et al. | 343/782 |
| 3,231,893 | 1/1966 | Hogg | 343/781 |
| 3,235,870 | 2/1966 | Hannan | 343/782 |

FOREIGN PATENTS OR APPLICATIONS

| | | | |
|---|---|---|---|
| 710,467 | 6/1954 | United Kingdom | 343/782 |

OTHER PUBLICATIONS

Ware et al., Electrical Communication, vol. 40, No. 2, 1965, pp. 200–203.

Richter, Nachrichtentechnische Fachberichte, vol. 45, pp. 111–115, 1972.

*Primary Examiner*—Eli Lieberman

*Attorney, Agent, or Firm*—James F. Hollander

[57] ABSTRACT

A Cassegrainian antenna having a feed horn, a subreflector and a main reflector exhibits subreflector reflections back toward the feed horn. Some of this energy is reflected by the feed horn, and some by the main reflector adjacent to the feed horn, back toward the subreflector. This doubly reflected energy constitutes an echo which is reduced in the prior art by using a flat reflector plate mounted near the subreflector to cancel energy radiated by the subreflector back toward the region of the feed horn. Herein is disclosed the addition of a frequency sensitive reflecting wire grid between the flat plate and the feed horn. A combined reflection from the grid, plate, and subreflector provides echo cancellation in two frequency ranges. The plate may be recessed in a hole in the subreflector. A guard ring surrounding the plate prevents leakage through the subreflector hole.

8 Claims, 4 Drawing Figures

ANTENNA WITH ECHO CANCELLING ELEMENTS

BACKGROUND OF THE INVENTION

The present invention relates to antennas for the transmission and reception of microwave energy. More particularly, the present invention relates to an improvement to a microwave antenna for reducing undesirable echo.

In the field of space comunications, a microwave antenna is used to transmit and receive many communications channels. One such antenna is the Cassegrainian antenna, which has a large concave main reflector, a smaller convex subreflector placed forward of the main reflector and a feed horn located centrally in an opening in the main reflector. Radiation from the feed horn is reflected from the subreflector to the main reflector and is transmitted from the antenna as a narrow microwave beam.

Unfortunately, some radiation transmitted from the feed horn is also undesirably reflected back toward the feed horn from the subreflector. The feed horn and adjacent main reflector reradiate part of this energy in the original forward direction. This undesirable doubly reflected energy is called an echo. The echo causes an objectionable intermodulation background noise component in the communications channels which sharply increases as the antenna size and number of channels is increased. See Bell Telephone Laboratories, *Transmission Systems for Communications*, 4th Ed., pp. 517–522, 1970.

Heretofore, undesirable echoes have been reduced by placing an essentially flat reflecting plate near the subreflector between the subreflector and the feed horn to cancel most of the energy reflected back toward the feed horn. When the plate reflects radiation which is equal in amplitude and 180 degrees out of phase at a given frequency with the reflection from the subreflector, good echo cancellation at that frequency is obtained. For a small number of communications channels, an acceptably small echo can be achieved over a moderate bandwidth. However, as the number of channels is increased, the echo at the edges of the band must be sharply reduced. An acceptable level cannot be achieved with a flat plate. Furthermore, some communications systems use distinct frequency ranges for simultaneous transmission and reception. Consequently, as the number of channels is increased to take full economic advantage of the antenna, the echo-caused noise in the frequency ranges rises above an acceptable level if just a flat plate is employed.

Accordingly, it is an object of the present invention to substantially cancel microwave echo reflections over a wide bandwidth in a microwave antenna accommodating a large number of communications channels.

It is another object of the present invention to substantially eliminate echo-caused channel noise from a Cassegrainian antenna accommodating a large number of communications channels.

It is another object of the present invention to substantially eliminate undesirable echo interference to transmitted and received communications channels carried in distinct frequency ranges in a microwave antenna.

SUMMARY OF THE INVENTION

The present invention involves an improvement to a microwave antenna having a main reflector, a subreflector, a feed system, and a flat plate placed near the subreflector in the path of incident radiation. In accordance with the present invention, a partially transmissive, frequency sensitive reflector which reflects a portion of incident radiation and transmits the rest, is placed between the flat plate and the feed system. A conductive grid may suitably be used for this purpose. The dimensions of the grid are selected so that proportionally more lower frequency than higher frequency energy is reflected from the grid. Correspondingly, more higher frequency than lower frequency energy can pass through the grid for reflection by the plate. In this manner, independently phase-adjustable reflections from the grid and plate are obtained in two frequency ranges. Thus, improved dual-frequency-band cancellation of the reflection from the subreflector, hence reduced echo, is obtained. The frequency ranges may overlap for wider bandwidth single-band operation as well.

BRIEF DESCRIPTION OF THE DRAWINGS

The invention will be more readily understood by reference to the following appended drawings.

DETAILED DESCRIPTION OF THE DRAWINGS

Figure 1:
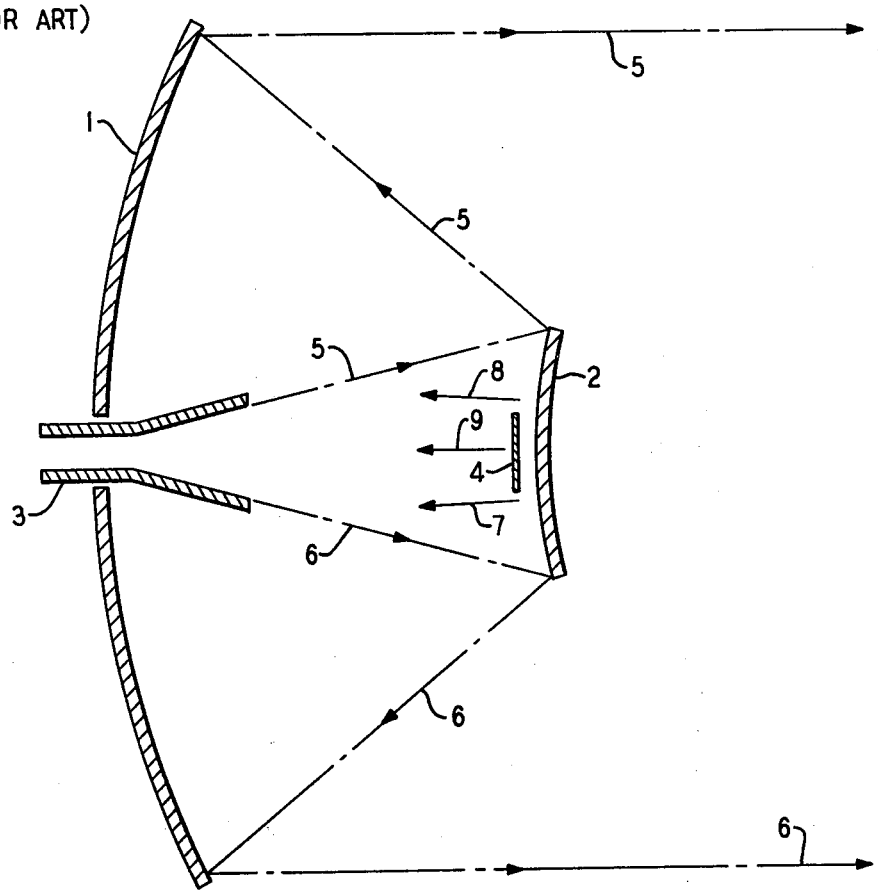
FIG. 1 (PRIOR ART)
FIG. 1 is a longitudinal cross section of a prior art microwave antenna having a single echo-cancelling flat reflector plate.

FIG. 1 is a longitudinal cross section of a prior art Cassegrainian antenna having an echo-cancelling reflector plate. This antenna consists of a feed system such as feed horn 3 which transmits a microwave beam including rays 5 and 6 to subreflector 2. Rays 5 and 6 are reflected to main reflector 1 and leave parallel with the beam from the antenna. Rays of undesirable reflection 7 and 8 return from subreflector 2 to the region of feed horn 3 producing impedance mismatch. Upon reflection from the feed horn and from the vicinity of the feed horn, part of the reflected energy is again radiated toward the subreflector, but delayed with respect to the original signal, i.e., an echo.

Flat reflector 4 placed near subreflector 2 reflects an echo-cancelling component indicated by ray 9 back toward feed horn 3, thus providing some cancellation of the reflected signal, and thus the echo. If the number of communications channels in a frequency range is increased substantially, however, the interference due to echo drastically increases. When energy is to be transmitted and received in two distinct frequency ranges or over a very broad frequency range, no adjustment in the position or size of flat plate 4 suffices to cancel the echo to the degree required.

Figure 2A:
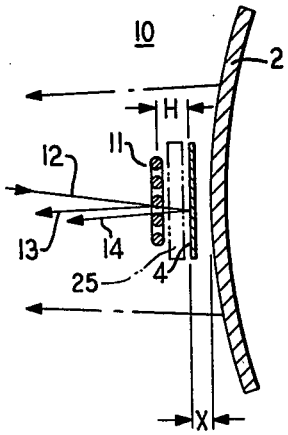
FIG. 2A is an enlarged longitudinal cross section of the region including the subreflector of a microwave antenna having a wire grid placed near the flat reflector plate in the manner of the present invention.
Figure 2B:
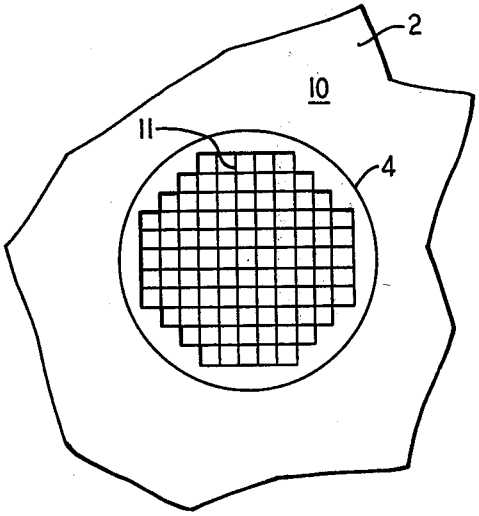
FIG. 2B is a broadside view of the wire grid, the flat plate, and a portion of the subreflector of FIG. 2A.

FIG. 2A shows a cross section of an improvement made to the antenna of FIG. 1 in the manner of the present invention. In the region of subreflector 2, a ray 12 carrying communications channels in each of two frequency ranges impinges upon a grid of cylindrical conductors 11 which is added between flat reflector 4 and the feed system not shown. FIG. 2B shows a broadside view of grid 11 which forms a square pattern of intersecting conductors over most of the area of circular flat plate 4 near subreflector 2.

The dimensions of the wire and the square holes in grid 11 are chosen so that grid 11 acts as a shunt inductance frequency sensitive partial reflector at the frequencies of interest. A radiation component 13 containing both lower and higher frequencies is reflected from grid 11. The rest of ray 12 is transmitted by the grid and reflected by plate 4 one or more times before emerging as component 14 and combining with component 13. Then when grid 11 is moved nearer to or farther from plate 4, holding plate 4 fixed, the phase of the reflection due to the grid and plate at the lower frequencies, as observed at the feed, is found to be more strongly affected than the phase at the higher frequencies. Conversely, if grid 11 is held fixed and plate 4 is moved, the plase of the reflection due to the grid and plate at the higher frequencies, as observed at the feed, is found to be more strongly affected than the phase at the lower frequencies.

The result is that the positions of grid 11 and plate 4 may be set so that the combined reflection from the grid and plate together has the correct phasing for cancelling undesired reflections from the subreflector, and thus most of the echo, in two frequency ranges. The two ranges may be separate for dual band operation or overlapping for a very broad single-band operation.

The subreflector reflection may be identified by a measurement technique such as the FM-CW or swept frequency type. See "Introduction to Radar Cross-Section Measurements", by P. Blacksmith, et. al., *Proceedings of the IEEE*, Volume 53, No. 8, August 1965, pp. 901–920.

The appropriate dimensions of the echo-cancelling structure comprising grid 11 and reflector plate 4 must be determined. A microwave antenna which is to be improved for extended echo cancellation properties is tested by the use of a flat reflector plate such as plate 4 of FIG. 1. The diameter of the flat plate which provides echo cancellation in the lower frequency range may suitably be chosen as the trial diameter of the flat plate for use in the dual-frequency echo-cancelling assembly 10 of FIG. 2A.

A grid of cylindrical wires intersecting at right angles is chosen to have dimensions such that it is a relatively better reflector at the lower frequencies than the higher frequencies. A suitable trial width dimension between successive crossings on the grid is about ¼ wavelength at the center of the lower of the two frequency ranges. A corresponding suitable trial diameter of the wire is a tenth as large as the trial crossing width. A suitable trial distance H between the plane of grid wire axes and the parallel surface of the plate nearest the grid is about ¼ wavelength at the center of the lower of the two frequency ranges.

An iterative experimental procedure may be used to determine the best grid-to-plate spacing H and plate-to-subreflector spacing X. A grid and plate assembly 10 having the above-mentioned trial dimensions is mounted adjustably on the subreflector 2. Two distances $X = X_1$ and $X = X_2$ of the plate from the subreflector which yield subreflector reflection cancellation, at the center of the lower and higher frequency ranges respectively, are determined and plotted versus H on a graph. If $X_2 = X_1$, H and X are determined. However, if the high frequency cancellation distance $X_2$ is farther from the subreflector than the low frequency cancellation distance $X_1$, i.e., if $X_2$ exceeds $X_1$, H must be decreased. Conversely, if $X_2$ is less than $X_1$, H must be increased.

When it is necessary to adjust H, the change may be made by an amount $\Delta H = -(X_2 - X_1)$. Then new $X_1$ and $X_2$ are determined by experiment and are plotted versus the new H. If $X_1$ differs from $X_2$ again, another change in H may be calculated from $\Delta H = -(X_2 - X_1)$ or obtained graphically by determining H at the intersection point of the line joining the points $X_1$ and the line joining the points $X_2$. The assembly is adjusted and tested by this iterative procedure until one position X suffices for cancellation in both frequency ranges.

If a cancellation is not sufficiently pronounced, adjustments in amplitude of the reflection may be made by proportionally increasing or decreasing the areas of the grid and plate.

The spacing H of the plate 4 behind grid 11 obtained from the procedure outlined above may be such as to require that a hole be made in subreflector 2 to accommodate the echo cancelling assembly. If a hole is not desired, the required distance between grid 11 and plate 4 may be reduced by inserting a slab of dielectric material 25 between the grid and plate in the course of construction and testing. However, the echo-cancelling assembly may readily be recessed in the subreflector as shown in FIG. 3.

Figure 3:
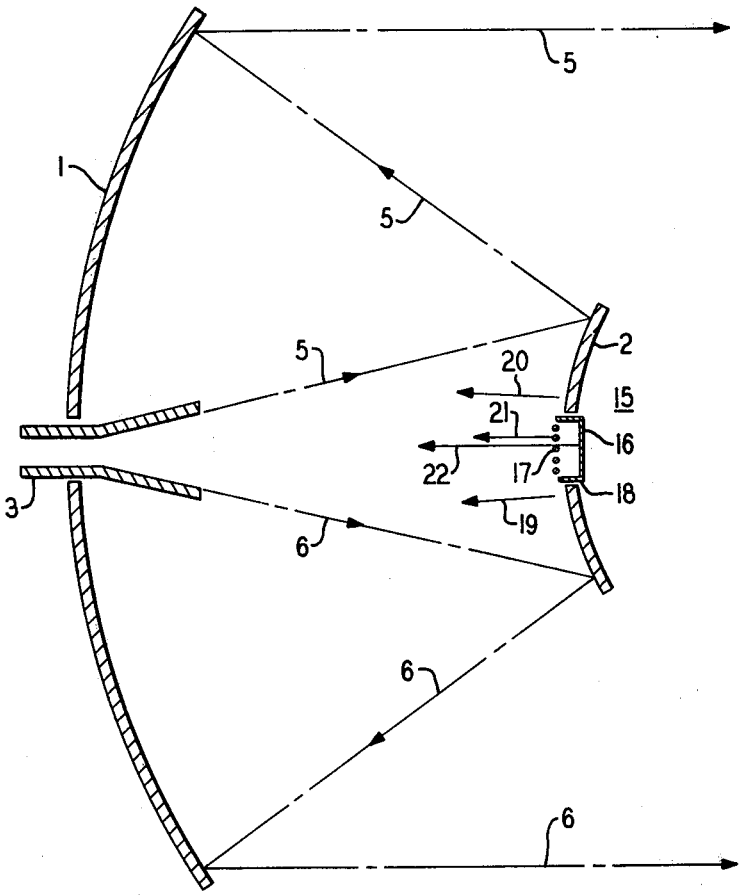
FIG. 3 is a longitudinal cross-sectional view of an embodiment of the present invention.

FIG. 3 is a longitudinal cross section of an embodiment of the present invention showing a dual frequency echo-cancelling assembly 15 recessed in a hole in subreflector 2 and surrounded by an interior edge of the subreflector. Feed horn 3 transmits rays 5 and 6 which are reflected from subreflector 2 and then from main reflector 1. A flat plate 16 is located slightly behind subreflector 2 in the path of incident radiation. A cylindrical wire grid 17, composed of wires intersecting at right angles, is supported by insulating posts or the like, parallel to plate 16 slightly forward of subreflector 2 toward the feed horn 3. A cylindrical conducting sleeve 18, called a guard ring, surrounds plate 16 at its perimeter and extends toward the grid to prevent leakage of radiation behind subreflector 2. The diameter of plate 16, the dimensions of grid 17, the spacing between grid 17 and plate 16, and the recessment of assembly 15 with respect to subreflector 2 are all chosen so that undesirable reflections 19 and 20 are cancelled in two frequency ranges respectively by the combination of reflection 21 and reflection 22.

The improvements described hereinabove may be applied in various antennas including the particular type of antenna illustrated. Also, a variety of partial reflectors may be employed as alternatives to the square grid disclosed. In these and other respects, it is to be understood that a wide variety of useful and convenient embodiments are comprehended in the spirit and scope of the present invention.

What is claimed is:

1. An antenna having a main reflector, a subreflector and a feed system so arranged that radiation from said feed system is successively reflected from said subreflector and said main reflector, said antenna further having an essentially flat plate mounted near said subreflector so as to reflect some of said radiation back toward said feed system, wherein the improvement comprises frequency sensitive reflector means comprising a grid of intersecting conductors located between said feed system and said plate near said plate and operating so that a first component of said radiation is reflected from said plate and a second component of said radiation is reflected by said frequency sensitive reflector means, said frequency sensitive reflector means and said plate presenting approximately equal areas to said radiation, whereby radiation from said feed system reflected back to said feed system by said subreflector is substantially cancelled in a first and a second frequency range by said first and second reflected components combined.

2. An antenna as claimed in claim 1 wherein said plate has a perimeter and said antenna further comprises a conductive sleeve attached to said plate around said perimeter and extending from said plate toward said grid.

3. An antenna as claimed in claim 1 wherein said grid is disposed parallel to said plate and said grid is composed of cylindrical wires forming squares.

4. An antenna as claimed in claim 1 wherein said antenna further comprises a dielectric slab placed between said grid and said plate.

5. An antenna as claimed in claim 1 wherein said flat plate is recessed behind said subreflector from said feed system and said subreflector has an interior surrounding edge through which radiation passes to said plate.

6. An antenna having a main reflector, a subreflector, and feed horn means in spatial relationship to each other such that radiation from said feed horn means is reflected from said subreflector and then from said main reflector, and a plate mounted near said subreflector in the path of said radiation, wherein the improvement comprises means for partially reflecting radiation incident thereupon, said reflecting means comprising a grid of intersecting conductors being located near said plate, said reflecting means and said plate presenting approximately equal areas to said radiation, some of said radiation being transmitted through said reflecting means to said plate, whereby radiation from said feed horn means reflected back to said feed horn means by said subreflector is substantially cancelled by a combined reflection from said reflecting means and said plate.

7. An antenna as claimed in claim 6 wherein said main reflector, said subreflector and said feed horn means form a Cassegrainian antenna.

8. An antenna as claimed in claim 6 wherein said plate is recessed behind said subreflector from said feed system and said subreflector has an edge admitting said radiation to said plate.

* * * * *